US006592422B1

(12) United States Patent
Rehkemper et al.

(10) Patent No.: US 6,592,422 B1
(45) Date of Patent: Jul. 15, 2003

(54) TOY FIGURE WITH DIFFERENT VOLUME LEVELS

(75) Inventors: Steven Rehkemper, Chicago, IL (US); Jeffrey Rehkemper, Chicago, IL (US)

(73) Assignee: Rehco, LLC, Chicago, IL (US)

( * ) Notice: Subject to any disclaimer, the term of this patent is extended or adjusted under 35 U.S.C. 154(b) by 0 days.

(21) Appl. No.: 10/307,578

(22) Filed: Dec. 2, 2002

(51) Int. Cl.[7] ..... A63H 33/26
(52) U.S. Cl. ..... 446/130; 446/139; 446/297
(58) Field of Search ..... 446/175, 297, 446/130, 132, 137, 139, 397

(56) References Cited

U.S. PATENT DOCUMENTS

| | | | | | |
|---|---|---|---|---|---|
| 5,290,198 | A | * | 3/1994 | Nakayama | 446/297 |
| 5,603,652 | A | * | 2/1997 | Rothschild et al. | 446/130 |
| 5,975,979 | A | * | 11/1999 | Ferri Llorens | 446/301 |
| 6,386,937 | B1 | * | 5/2002 | Cappello et al. | 446/139 |
| 6,428,321 | B1 | * | 8/2002 | Jurmain et al. | 434/238 |

* cited by examiner

*Primary Examiner*—Derris H. Banks
*Assistant Examiner*—Ali Abdelwahed

(57) ABSTRACT

In accordance with the present invention there is provided a toy figure in combination with a toy megaphone. The toy figure includes a circuit board to store pre-programmed audio outputs having different volume levels and a speaker to emit the pre-programmed audio outputs. The toy figure also includes a switch to activate the emitting of an audio output with a first volume level, as well as a sensor that when activated triggers the toy figure to emit a second audio output with a second volume level that is different than the first volume level. The toy megaphone has the ability to activate the sensor such that the toy figure emits the second audio output. When the toy figure is activated through the switch, the toy figure will emit the first audio output with a first volume level until the toy megaphone comes in proximity to the sensor in the toy figure, at which point the toy figure will emit the second pre-programmed audio output that has a second volume level different from the first volume level. Preferably, the first volume level is softer or lower than the second volume level.

9 Claims, 3 Drawing Sheets

TOY FIGURE WITH DIFFERENT VOLUME LEVELS

FIELD OF THE INVENTION

The present invention relates to toy figures and more specifically to a toy figure with pre-recorded audio outputs with different volume levels and that are triggered by a user.

BACKGROUND OF THE INVENTION

Toy figures have always been the mainstay as a toy for young children. Included therewith are toy figures that when activated by the user, are able to talk or sing in response thereto. For example, in some instances a switch may be placed within the toy figure, which when pressed causes the toy figure to emit various sounds or noises. In yet other toy figures, the toy figure will respond when a magnetic material placed in another object is in:proximity to a sensor or switch within the toy figure, such as in U.S. Pat. No. 5,603,652. However, there is always a continual need for improvements and new and novel features.

SUMMARY OF THE INVENTION

In one embodiment of the present invention there is provided a toy figure in combination with a toy megaphone. The toy figure includes a circuit board to store pre-programmed audio outputs having different volume levels and a speaker to emit the pre-programmed audio outputs. The toy figure also includes a switch to activate the emitting of an audio output with a first volume level, as well as a sensor that when activated triggers the toy figure to emit a second audio output with a second volume level that is different than the first volume level. The toy megaphone has the ability to activate the sensor such that the toy figure will emit the second audio output. When the toy figure is activated through the switch, the toy figure will emit the first audio output with a first volume level until the toy megaphone comes in proximity to the sensor in the toy figure, at which point the toy figure will emit the second pre-programmed audio output that has a second volume level different from the first volume level. Preferably, the first volume level is softer or lower than the second volume level.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein.

DETAILED DESCRIPTION OF THE DRAWINGS

Figure 1:
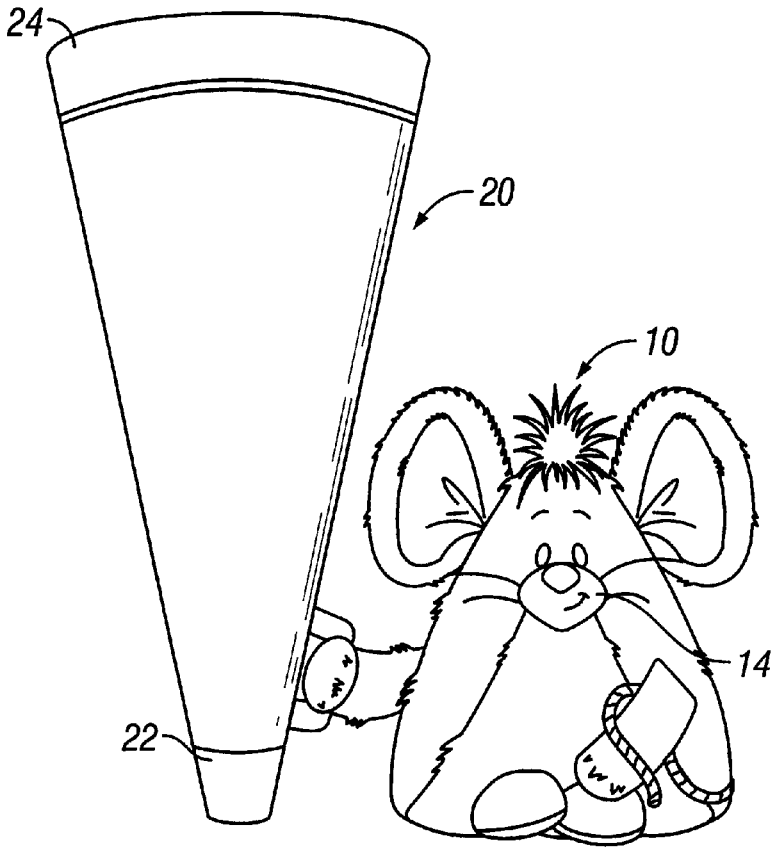
FIG. 1 is a front view of the present invention illustrating a toy figure with a megaphone.

While the invention is susceptible to embodiments in many different forms, there are shown in the drawings and will be described herein, in detail, the preferred embodiments of the present invention. It should be understood, however, that the present disclosure is to be considered an exemplification of the principles of the invention and is not intended to limit the spirit or scope of the invention and/or claims of the embodiments illustrated.

Referring now to FIG. 1, a toy FIG. 10 is illustrated along with a megaphone 20 that when placed in proximity to the mouth 14 of the toy FIG. 10 will trigger higher volume sounds or audio outputs, thus providing the appearance of a real functioning megaphone. While depicted throughout the drawings as a mouse, the actual external configuration of the toy FIG. 10 is not material to the scope of the invention.

Figure 2:
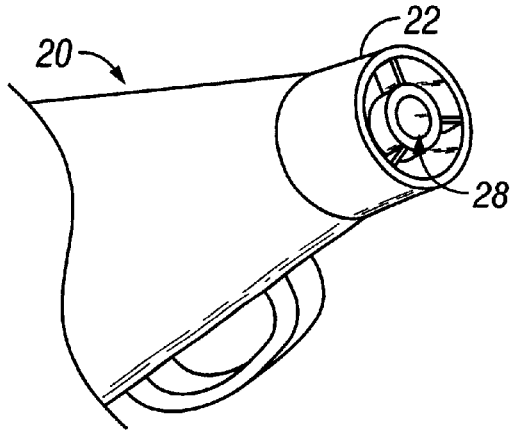
FIG. 2 is a perspective view of the smaller end of the megaphone illustrating a magnet placed within the megaphone that is used to trigger the toy figure's pre-programmed higher volume audio outputs.
Figure 3:
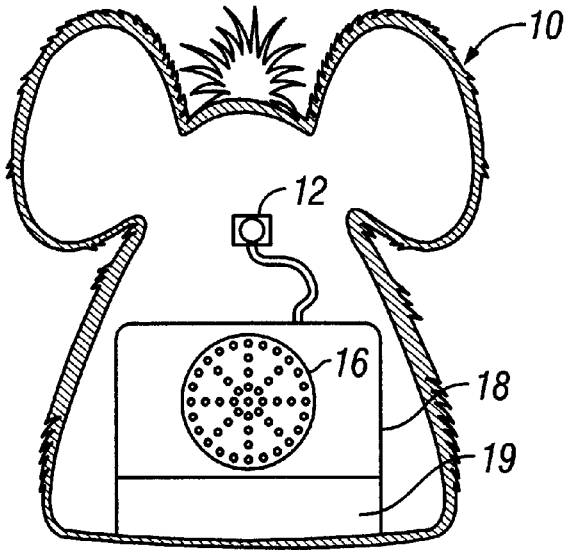
FIG. 3 is a partial internal view of the toy figure illustrating among other things a sensor that may be triggered by the magnet in the megaphone.

The megaphone 20 has a smaller end 22 and a larger end 24 such as a real megaphone would appear. However, if used by a person, the megaphone 20 does not electronically amplify a person's voice. As shown in FIG. 2 the smaller end 22 of the megaphone 20 includes a magnet 28 or another type of triggering means. The toy FIG. 10, as seen in FIG. 3, includes a sensor 12 (such as a hall effect sensor) positioned about the mouth 14 of the toy FIG. 10. However, another type of sensor or receiving means may be used that is capable of being triggered by a corresponding triggering or transmitting means. The toy figure also includes a speaker 16. The various components are powered and controlled by a power source 18 and a circuit board with an appropriate sound chip generally referenced as 19. The sound chip is used to store various pre-recorded sounds.

Figure 4A:
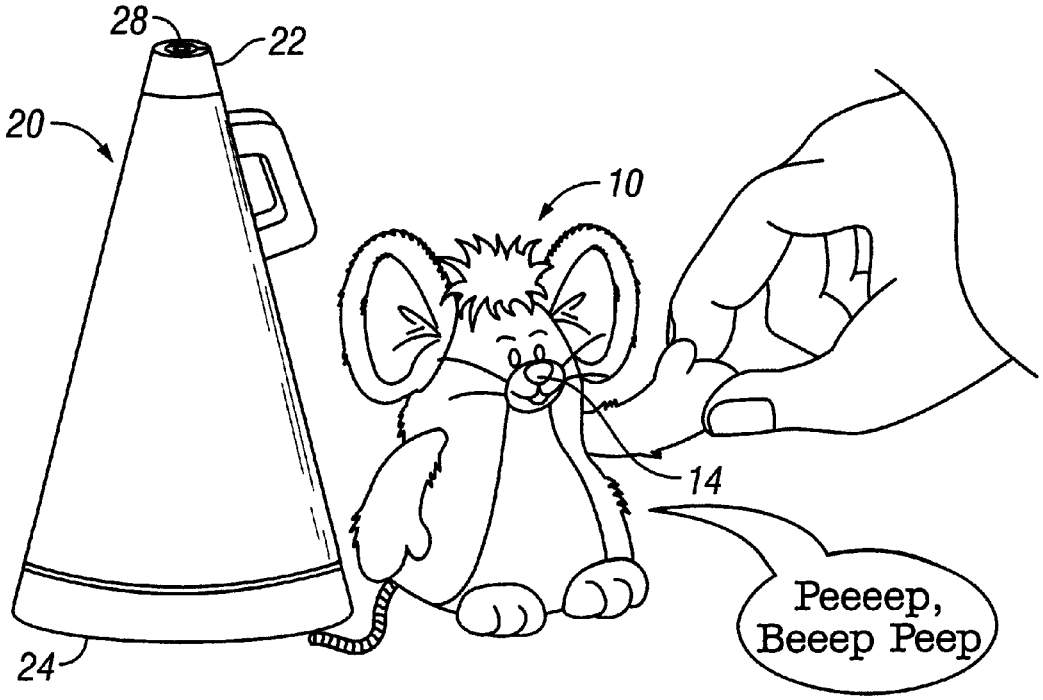
FIGS. 4*a*–4*c* are perspective views showing the operation of the toy figure and the megaphone.
Figure 4B:
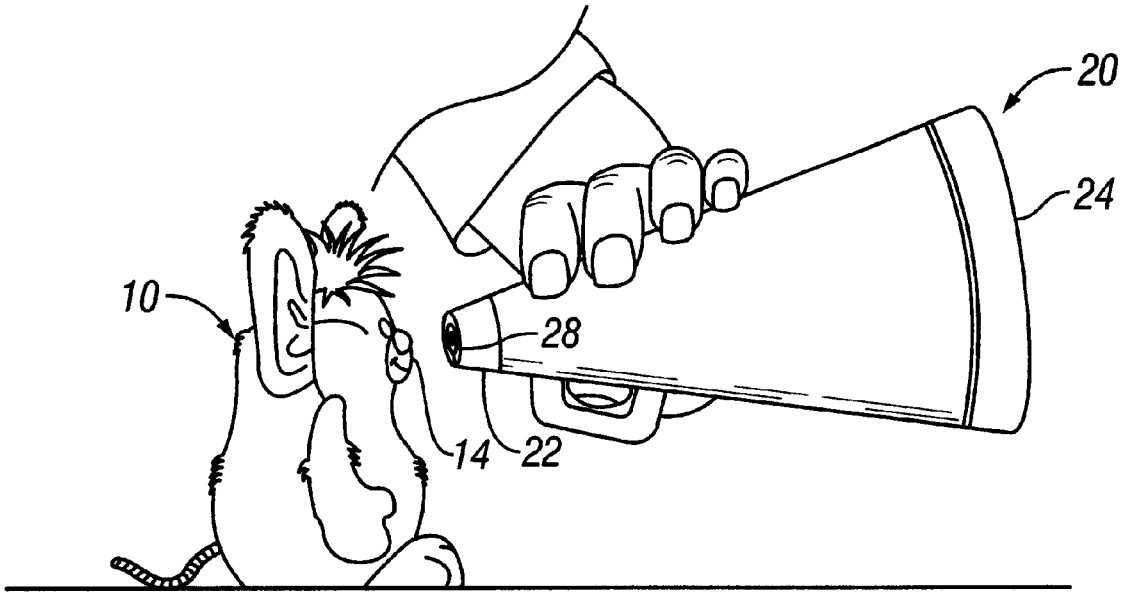
Figure 4C:
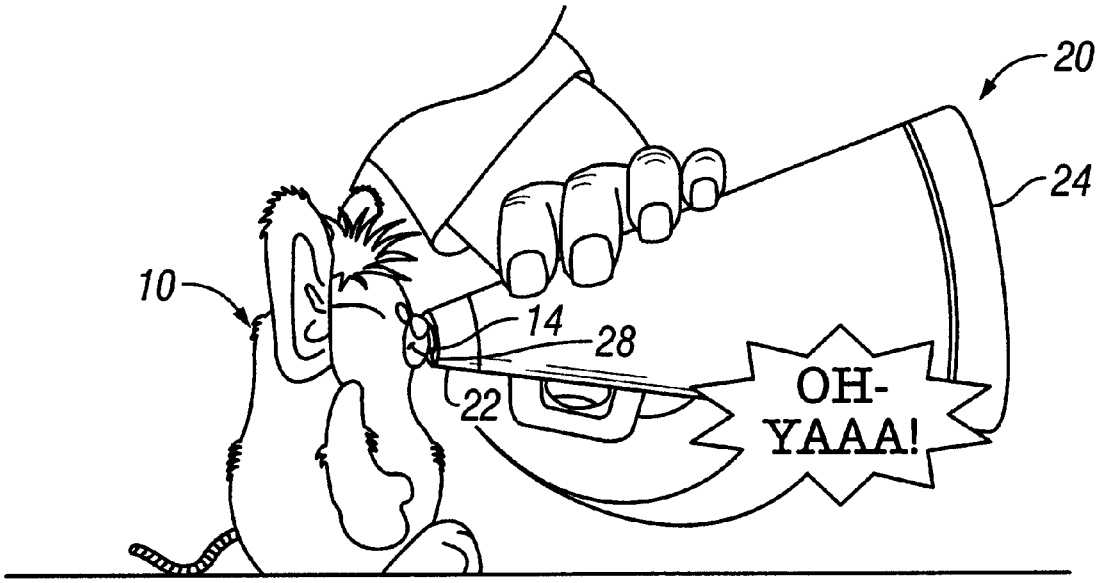

Referring now to FIGS. 4*a*–4*c*, a brief explanation of the overall operation of the toy FIG. 10 and megaphone 20 from FIGS. 1–3 will now be presented. To turn the toy FIG. 10 on a user presses or squeezes a switch (not shown) in one of the toy figures hands or feet. When activated and not in proximity of the megaphone 20, the toy FIG. 10 will emit from the speaker 16 low volume or soft toned sounds (FIG. 4*a*). The sounds are retrieved from the sound chip on the circuit board. A user then places the smaller end 22 (which contains the magnet 28) of the megaphone 20 near the mouth 14 of the toy FIG. 10, which triggers the sensor 12 (FIG. 4*b*). This in turn triggers alternate or modified pre-programmed sounds (FIG. 4*c*) that have a higher volume or tone than the original soft toned sounds, which are also retrieved from the sound chip.

The change in volume may either be dynamic (such that the toy FIG. 10 may change volume in the middle of a sentence) or static (meaning the entire phrase or alternate phrases may be loud). The megaphone 20 is also not actually a real functioning megaphone in that if used by a user, the megaphone 20 does not electronically amplify sounds. However, it is conceivable that a megaphone could be constructed that both triggers the sensor in the toy figure and amplifies the sounds of a user.

From the foregoing and as mentioned above, it will be observed that numerous variations and modifications may be effected without departing from the spirit and scope of the novel concept of the invention. It is to be understood that no limitation with respect to the specific methods and/or apparatus illustrated herein is intended or should be inferred. It is, of course, intended to cover by the appended claims all such modifications as fall within the scope of the claims.

We claim:

1. A toy figure in combination with a toy megaphone comprising:

a toy figure having an activation means, a sensor positioned about a mouth defined by the toy figure, a circuit board to store pre-programmed sounds, the pre-programmed sounds including both low volume and high volume sounds, and a speaker to emit the low volume pre-programmed sounds when activated and to emit the high volume sounds when triggered by the sensor; and a toy megaphone having an end with a triggering means, the triggering means when in proximity to the sensor in the toy figure, triggers the sensor such that the toy figure emits the high volume sounds.

2. The toy figure in combination with a toy megaphone according to claim 1, wherein the triggering means is a magnet and the sensor is a hall-effect sensor.

3. A toy assembly comprising:

a toy figure having a mouth, a switch to activate a playing of low volume sounds, a sensor placed within the mouth for triggering a playing of high volume sounds, a circuit board to store pre-programmed sounds including the low volume sounds and the high volume sounds, and a speaker to emit the low volume sounds and the high volume sounds; and a toy megaphone operative to trigger the sensor when in proximity to the sensor whereby when the toy figure is emitting low volume sounds and the toy megaphone is positioned in proximity to the mouth of the toy figure, the toy figure will stop emitting the low volume sounds and begin emitting the high volume sounds.

4. The toy assembly of claim 3, wherein the toy megaphone has a magnet in one end of the megaphone for triggering the sensor.

5. The toy assembly of claim 4, wherein the sensor is a hall-effect sensor.

6. The toy assembly of claim 5, wherein the switch is placed in a hand defined by the toy figure.

7. A toy figure in combination with a toy megaphone comprising:

a toy figure having:

a circuit board to store pre-programed audio outputs having different volume levels, a speaker to emit the pre-programmed audio outputs, a switch to activate the circuit board to emit a first pre-programmed audio output, wherein the first pre-programmed audio output has a first volume level, and a sensor means that when activated triggers the circuit board to emit a second pre-programmed audio output, wherein the second pre-programmed audio output has a second volume level, and the second volume level is higher than the first volume level; and a toy megaphone having a means to activate the sensor means, whereby when the switch is activated, the toy figure emits a first pre-programmed audio output having a first volume level until the toy megaphone comes in proximity to the sensing means at which point the toy figure will emit a second pre-programmed audio output having a second volume level different from the first volume level.

8. The toy figure in combination with the toy megaphone of claim 7, wherein the sensing means in the toy figure is a hall-effect sensor and is placed about a mouth defined by the toy figure.

9. The toy figure in combination with the toy megaphone of claim 8, wherein the means for activating the sensor means is a magnet placed in one end of the megaphone.

* * * * *